United States Patent [19]

Mulder

[11] 4,092,557

[45] May 30, 1978

[54] INTENSIFIER TUBE OF THE PROXIMITY FOCUS TYPE

[75] Inventor: Hendrik Mulder, Delft, Netherlands

[73] Assignee: N. V. Optische Industrie "De Oude Delft", Delft, Netherlands

[21] Appl. No.: 704,529

[22] Filed: Jul. 12, 1976

[30] Foreign Application Priority Data

Jul. 23, 1975 Netherlands ..... 7508791

[51] Int. Cl.[2] ..... H01J 39/00; H01J 39/02

[52] U.S. Cl. ..... 313/102; 250/213 VT; 313/101

[58] Field of Search ..... 313/94, 101, 102, 100, 313/475, 372, 95; 250/213 VT, 213 R

[56] References Cited

U.S. PATENT DOCUMENTS

| | | | |
|---|---|---|---|
| 3,229,105 | 1/1966 | Mestwerdt et al. | 250/213 VT |
| 3,267,283 | 8/1966 | Kapany | 250/213 VT X |
| 3,304,455 | 2/1967 | Mesta | 313/94 |
| 3,356,851 | 12/1967 | Carlson | 250/213 VT |
| 3,458,744 | 7/1969 | Sowers et al. | 313/94 |
| 3,712,986 | 1/1973 | Collings | 313/102 X |
| 3,828,192 | 8/1974 | Morsell | 313/100 X |
| 3,989,971 | 11/1976 | Santilli et al. | 313/102 X |

*Primary Examiner*—Robert Segal
*Attorney, Agent, or Firm*—O'Brien & Marks

[57] ABSTRACT

An image intensifier tube of the proximity focus type has a transparent cathode window with a curved inner surface and an anode window formed by a fiber optics plate having an inner surface curved to be substantially complementary to the cathode window inner surface. The arrangement mitigates the so-called "chicken-wire" effect and other flaws inherent in intensifiers using fiber optics at both the cathode and the anode ends. It is cheaper in manufacture and may be made of smaller depth, thereby simplifying its incorporation in existing apparatus.

1 Claim, 2 Drawing Figures

INTENSIFIER TUBE OF THE PROXIMITY FOCUS TYPE

This invention relates to an image intensifier tube of the so-called proximity focus type.

Such image intensifier tubes are well-known, and comprise an internally plane cathode window carrying a photosensitive layer facing a phosphor layer provided on an internally plane anode window. The anode window and the cathode window are interconnected in a suitable manner by a generally cylindrical tube wall, the plane space enclosed by the tube wall, the cathode window and the anode window being substantially evacuated. The distance between the cathode and the anode is in the order of 1 mm.

Image intensifier tubes of the kind described above can be used for intensifying a curved image provided by an optical system, the aim being to provide a generally plane output image, which can be recorded, for example, by direct contact, on a suitable film. For this purpose a fibre-optics plate is used both at the cathode end and at the anode end. The plate at the cathode end has an outer surface conforming to the optical system, and the plate at the anode end serves for bringing the image outside the vacuum.

However, the use of a fibre optics plate at both the cathode end and the anode end involves some disadvantages. First, these plates are rather expensive. Second, the so-called "chicken-wire" effect occurs as a result of the fact that a fibre optics plate is built up from bundles of light transmitting channels, while other flaws, such as dark spots and the like may also occur. Third, there is always some loss of light when a fibre optics plate is used.

It is an object of the present invention to mitigate these drawbacks.

According to the present invention, therefore, there is provided an image intensifier tube of the proximity focus type, characterized by an internally curved transparent cathode window, and by an anode window formed by a fibre optics plate whose surface facing the cathode window has a shape substantially complementary to the latter.

Figure 1:
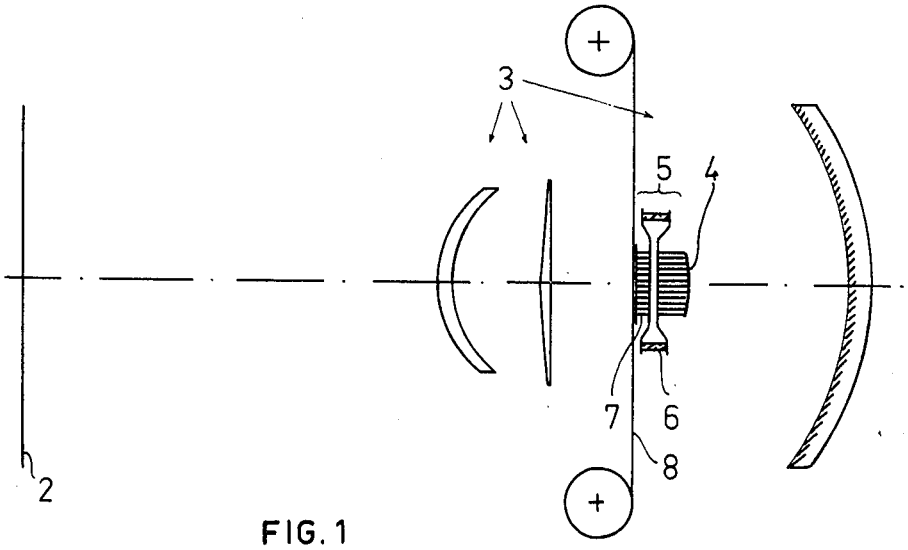
Figure 2:
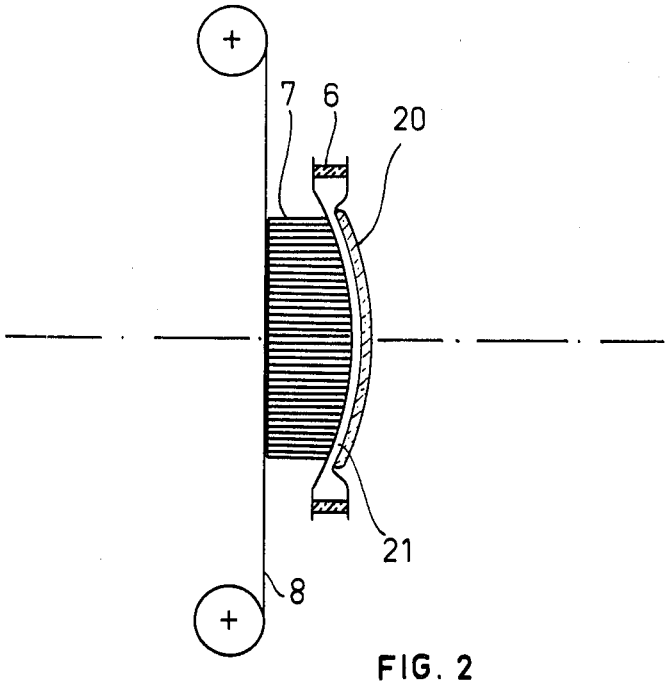

One embodiment of the present invention will now be described, by way of example, with reference to the accompanying schematic drawings, in which FIG. 1 shows an X-ray screen image camera utilizing an image intensifier tube of the proximity focus type of the prior art; and FIG. 2 shows an embodiment of an image intensifier tube in accordance with the present invention, employed in the X-ray screen image camera of FIG. 1.

Referring to FIG. 1, there is shown an X-ray screen image camera with an X-ray screen 2 and an optical system 3, capable of focusing the X-ray image on to a cathode fibre optics plate 4 of a prior art image intensifier tube 5 of the proximity focus type. The image intensifier tube comprises a fibre optics cathode plate 4 which by means of a tube wall 6 is connected in vacuum-tight manner to fibre optics anode plate 7. The cathode and anode plates are coated in known manner on the inside of the tube with a photosensitive layer and a phosphor layer, respectively, which are not shown in FIG. 1. The anode may be provided with a transparent conductive layer. A film 8 for recording the images produced can be transported along the anode window. The shape of the side of the cathode plate facing the optical system 3 is determined by the configuration of the optical system. It may be spherical in shape, but other forms are conceivable.

FIG. 2 shows an image intensifier tube of the proximity focus type in accordance with the present invention. According to this invention, the fibre optics cathode plate 4 is replaced by a transparent input window 20, which may be of glass, for example, and the inner and outer surfaces of which are so curved as to satisfy the requirements imposed by the optical system. The surface of the anode plate facing the cathode of the tube has virtually the same curvature as the inner surface of the cathode, so that a virtually uniform interspace 21 is formed between the cathode and the anode. The end of the anode plate away from the interior of the tube is preferably plane, so that film 8 may be pressed into contact with the anode plate in a simple manner for recording the images produced.

The construction according to this invention offers various advantages. First, according to the invention, instead of the fibre optics cathode plate a transparent, e.g., a glass window is used, which is considerably cheaper. Further, the so-called "chicken-wire" effect, resulting from the use of fibre optics plates, is reduced, while other flaws which are often concomitant with the use of fibre optics plates are also mitigated. Another important advantage resulting from the use of only one fibre optics plate is the gain in light compared with the prior construction. A further advantage which may be mentioned is that the thickness may be smaller than that of the prior construction, which simplifies the incorporation of an image intensifier tube of the proximity focus type in existing apparatus.

I claim:

1. An image intensifier tube of the proximity focus type for use with an optical focusing system comprising a transparent input window having inner and outer surfaces which are curved to satisfy the requirements of the optical focusing system, a photosensitive layer on the inner surface of the input window a fiber optic plate having one a convex surface uniformly disposed about 1 millimeter from the inner surface of the input window, a phosphor layer on said convex surface of the fiber optic plate, said input window and said photosensitive layer thereon being concave and of substantially the same curvature as said convex surface, the other surface of the fiber optic plate being planar, means forming an enclosed space between said concave surface of the input window and said convex surface of the fiber optic plate, and said enclosed space being substantially evacuated.

* * * * *